US007057142B1

(12) United States Patent
Lubrina

(10) Patent No.: US 7,057,142 B1
(45) Date of Patent: Jun. 6, 2006

(54) OVEN CONTROL SYSTEM

(75) Inventor: Yves Lubrina, Poligny (FR)

(73) Assignee: Thirode Grandes Cuisines Poligny, Poligny (FR)

( * ) Notice: Subject to any disclaimer, the term of this patent is extended or adjusted under 35 U.S.C. 154(b) by 305 days.

(21) Appl. No.: 10/617,613

(22) Filed: Jul. 11, 2003

(30) Foreign Application Priority Data

Jul. 26, 2002 (FR) ..... 02 09527

(51) Int. Cl.
*H05B 1/02* (2006.01)

(52) U.S. Cl. ..... 219/506; 219/720; 219/494; 99/325; 99/DIG. 14

(58) Field of Classification Search ..... 219/492, 219/494, 501, 506, 414, 720, 413; 99/325, 99/DIG. 14
See application file for complete search history.

(56) References Cited

U.S. PATENT DOCUMENTS

| | | | | |
|---|---|---|---|---|
| 4,405,991 A | | 9/1983 | Stanley | |
| 4,933,527 A | * | 6/1990 | Edamura | 219/714 |
| 5,274,209 A | * | 12/1993 | Edamura | 219/714 |
| 6,097,016 A | * | 8/2000 | Hirata et al. | 219/720 |
| 2003/0161922 A1 | | 8/2003 | Hillmann | |

FOREIGN PATENT DOCUMENTS

| | | |
|---|---|---|
| DE | 3920257 | 1/1991 |
| EP | 0576146 | 12/1993 |
| EP | 0677265 | 10/1995 |
| EP | 0852319 | 7/1998 |
| EP | 0971173 | 1/2000 |
| EP | 1338849 | 8/2003 |
| GB | 2323436 | 9/1998 |
| WO | 2 061 576 | 5/1981 |
| WO | WO 01/12036 | 2/2001 |

OTHER PUBLICATIONS

Eloma; Eloma GmbH; pp. 1–20.
Der ClimaPlus Combi; Rational; pp. 1–21.
Combi–Dämpfer; Die neue>>C–Linie<<; Rational.
Combi ClimaPlus; Frima.
Fours Mixtes Genius; pp. 1–44.

* cited by examiner

*Primary Examiner*—Mark Paschall
(74) *Attorney, Agent, or Firm*—Meyertons, Hood, Kivlin, Kowert & Goetzel, P.C.; Eric B. Meyertons

(57) ABSTRACT

Oven control system, comprising a display screen 9, a data input means 32 and a calculation unit 8 able to send instructions to the display screen 9 and to receive instructions from the data input means, the said calculation unit 8 comprising a means for grading cooking programmes at least as a function of a first criterion of family of products to be cooked, of product to be cooked within a family, or of recipe or of method of cooking, and a means for adjusting the cooking programme according to at least one second internal final criterion and one third external final criterion, the display screen 9 being able to simultaneously display the selected values of the said criteria or the values of the said criteria currently being selected by a user, with a zone for displaying the values of the second and third criteria and which is designed to also display unselected values of the said criteria in such a way that the selected values can be read graphically, the said display zone being able to display a window adapted to each type of product.

18 Claims, 7 Drawing Sheets

OVEN CONTROL SYSTEM

BACKGROUND OF THE INVENTION

1. Field of the Invention

The present invention relates to the field of ovens, in particular culinary ovens, of individual type, for example for equipping the home, of communal type, for example for a school or company canteen, or else industrial, for the preparation of cooked dishes in the food processing field.

2. Description of the Related Art

The cooking of foods requires extensive and varied culinary knowledge, and poses problems concerned with the adjustment of temperature and the monitoring of cooking, on account of the considerable modifications of appearance and of taste that they are liable to undergo.

For example, the cooking of red meat, such as roast beef, is one of the trickiest ones. The user or the consumer may want to cook to "very rare", "rare" or "medium rare", also termed "well done". The difference in temperature between these three types of cooking right in the middle of a joint of roast beef is of the order of 1 or 2° C.

Conventionally, an oven is equipped with a button for adjusting the temperature with thermostatic or electronic type regulation. Certain ovens are equipped with a cooking mode selector based on a mechanical switch or electronic selector for choosing a degree of humidity inside the oven. Finally, a mechanical or electronic timer makes it possible to control the end of cooking.

However, these controls require skill by the user who must, if desirous of ensuring quality cooking, be fully aware of how to adjust the setting for cooking mode, for temperature and for duration to be applied as a function of the type of product, of the quality of the product and of the oven load, that is to say of the quantity of product placed in the oven.

Furthermore, high quality cooking often requires different cooking phases, which ensure the coloration of the product, that it cooks right through to the middle and that its temperature is maintained, these being difficult to achieve by simple control on account of the knowledge that the user must possess and of the multiple interventions on the control buttons of the oven when cooking is in progress.

Certain more advanced ovens allow storage of cooking programmes with automatic sequencing of various phases, with for each phase a specified temperature preset, a specified duration and a specified mode of cooking. Each programme then corresponds to a type of product.

However, each programme builds in settings adjusted by the manufacturer which, although the manufacturer regards them as ideal, do not necessarily give rise to cooking that is to the user's taste. For example, a joint of roast beef may turn out to be too coloured, too dry, not rare enough, etc. The user is then led to create a new programme presumed to improve the disputed characteristic.

As before, the user must then be fully aware of the product and the way of cooking it, in order to know which cooking phase to modify as well as which control, temperature, duration, mode of cooking, etc.

In practice, the user must fully master the generation of a new programme and perform multiple trials, often leading to their giving up, this being, moreover, time consuming and carrying the risk that certain products to be cooked may be rendered inedible.

SUMMARY OF THE INVENTION

The invention proposes to remedy these drawbacks by virtue of a control system tailored to users, even beginners, without it being necessary to refer to a user manual, with control by means of results criteria.

The oven control system according to one aspect of the invention, comprises a display screen, a data input means and a calculation unit able to send instructions to the display screen and to receive instructions from the data input means, the said calculation unit comprising a means for grading cooking programmes at least as a function of a first criterion of families of products to be cooked, of products to be cooked within a family, or of recipes or of methods of cooking, and a means for adjusting the cooking programme according to at least one second internal final criterion and one third external final criterion, the display screen being able to simultaneously display the selected values of the said criteria or the values of the said criteria currently being selected by a user, with a zone for displaying the values of the second and third criteria and which is designed to also display unselected values of the said criteria in such a way that the selected values can be read graphically, the said display zone being able to display a window adapted to each type of product.

The second and third criteria are said to be "final", that is to say they relate to a characteristic of the product on termination of cooking. In contradistinction, a "technical", criterion is a characteristic of the cooking, such as the duration of a phase, the temperature, the mode of cooking, etc.

Advantageously, the display screen comprises a display zone for the names of the first criterion and a display zone for the selected value of the said criterion or of the values currently being selected. The display zone for the name of the first criterion may be permanent.

In one embodiment of the invention, the display zone for the values of the second and third criteria comprises at least one criterion-based bar graph.

In one embodiment of the invention, the display screen comprises a display zone for the names of the second and third criteria. The said display zone for the names of the second and third criteria may be arranged on both sides of the display zone for the values of the second and third criteria.

Advantageously, the system comprises a means for selecting the second and third criteria from a list of criteria.

In one embodiment of the invention, the calculation unit comprises a storage table associating an instruction for displaying an adapted window with each type of product.

Advantageously, the said calculation unit comprises a means for grading cooking programmes at least as a function of a fourth criterion and of a fifth criterion.

The invention also proposes an oven comprising a frame, a door, heating means, for example an electrical resistor, and an oven control system.

The control system makes it possible to offer the user a whole bank of pre-programmed recipes with the possibility of tailoring the result to his tastes by modifying a cooking result preset, without recreating new cooking programmes, without having to be, either by memorizing, or by consulting a book of recipes, of the cycles to be modified and the associated parameters, doing so in clear language directly accessible to a cook, tailored and varying according to each product.

The final criteria that the user can modify are in particular an external criterion, for example appearance, in particular coloration in the case of cooking of meat, and an internal final criterion, of the kind rare/medium rare, firm/tender, dry/moist, etc.

The display screen may be of the LCD type, allowing the display of information in several configurable languages, the control of modifications being performed by one or two coders affording access to the menus and to the choices proposed on the screen.

Access to the programme is effected through a criterion of family, for example beef, veal, pork, vegetables, fish, patisserie, etc., by a criterion of product within that family, for example joint of beef, rib of beef, braised beef, etc., in the case of beef, a criterion of recipe or of method of cooking, for example regular joint, joint in pastry, regular cooking or else overnight cooking, that is to say of long duration. Such access to the recipe by means of several hierarchical criteria is particularly easy for an inexperienced user of the oven equipped with the control system.

The final criteria are defined according to the family, the product and the type of cooking, and are displayed by means of a bar graph associated with a designation of the criterion.

Furthermore, the display screen comprises a zone designating the cooking facility to be used, for example a rack, a baking tray, a perforated tray, of this or that depth, the estimated cooking time and the automatic preheating related to the chosen product.

BRIEF DESCRIPTION OF THE DRAWINGS

The present invention will be better understood on studying the detailed description of an embodiment taken by way of wholly nonlimiting example and illustrated by the appended drawings, in which.

DETAILED DESCRIPTION OF PREFERRED EMBODIMENTS

Figure 1:
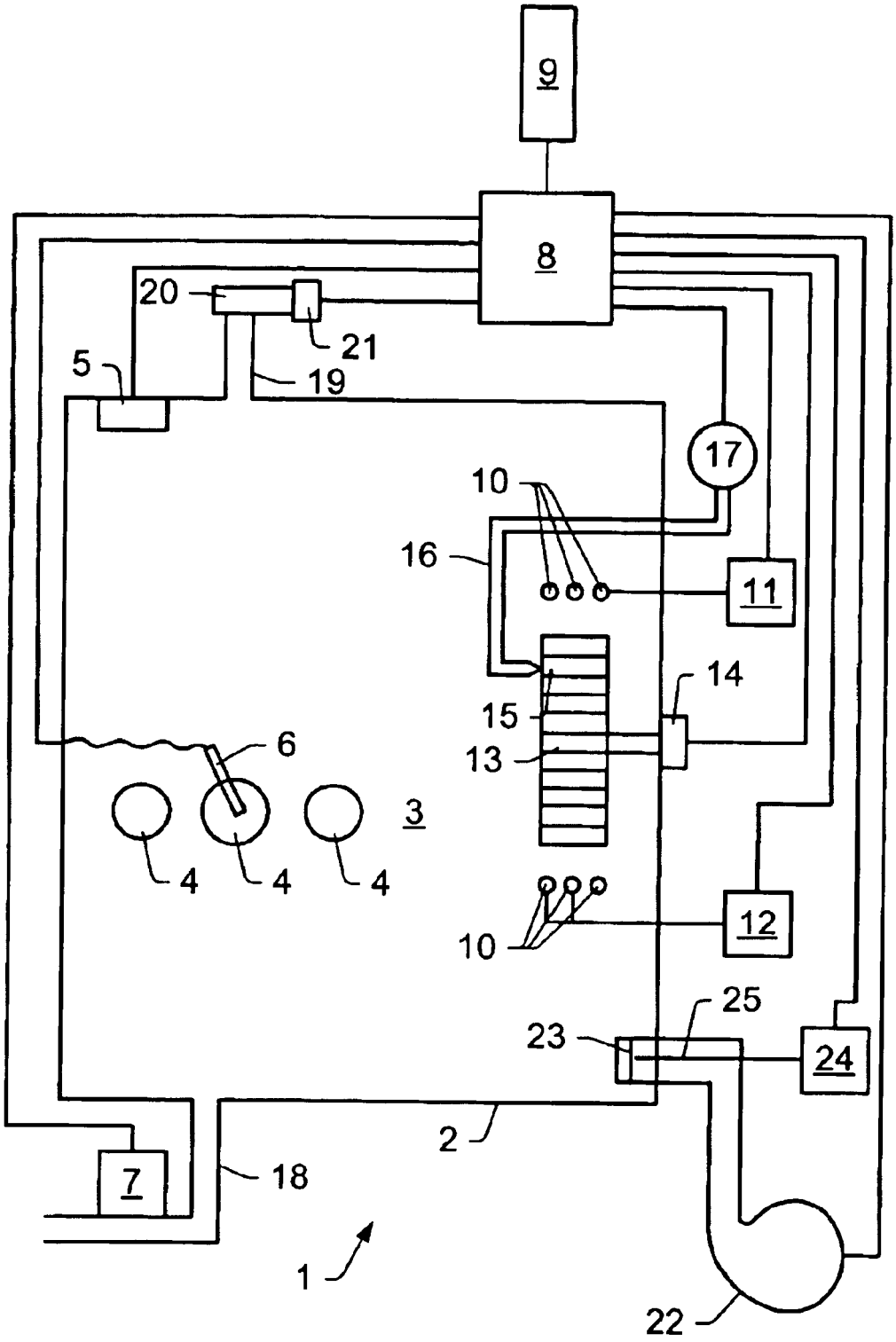
FIG. 1 is front elevation view of an oven according to one aspect of the invention.

As may be seen in FIG. 1, the oven 1 comprises an enclosure 2 defining an interior space 3. The enclosure 2 is provided with a door, not represented, and is of lagged type, comprising, as is known, an outside wall, an inside wall and an insulation material arranged between the outside wall and the inside wall. For reasons of ease of cleaning and of hygiene, the outside and inside walls may be made of stainless steel sheet. Racks, not represented, may be arranged in the interior space 3, making it possible to arrange dishes or products to be cooked. Represented here are joints of roast beef 4, of mutually differing sizes.

The oven 1 comprises a sensor 5 of the temperature $T_e$ of the interior space 3, a sensor 6 of the temperature $T_p$ in the middle of the products to be cooked 4, taking the form of a probe that can be stuck into the product 4, and a sensor 7 for measuring the temperature $T_1$ of the liquid which condenses in the interior space 3.

The sensors 5, 6 and 7 are linked, for example by wires, to a calculation unit 8 suitable for interpreting the data received. The calculation unit 8 comprises a microprocessor, one or more memories, a bus for communication between the microprocessor and the memory and one or more pieces of software stored in the memory and suitable for being executed by the microprocessor. The central unit 8 is associated with a control panel 9 allowing the displaying of information, for example of the temperature $T_e$ of the interior space 3 as measured by the sensor 5, and control buttons which will be explained in greater detail with reference to FIG. 5.

The oven 1 comprises, furthermore, a plurality of heating resistors 10, here three, of circular overall shape, and controlled, one by an interface 11, for example an electromechanical relay, and the other two by an interface 12 which may be of the same kind. The interfaces 11 and 12 are linked to the calculation unit 8. A centrifugal fan 13 is arranged in the circular space between the resistors 10 and is driven by a motor 14 also linked and controlled by the calculation unit 8.

In proximity to the fan 13 is arranged a nozzle 15 linked to a conduit 16 on which is arranged an electrovalve 17 linked and controlled by the central unit 8. The opening of the electrovalve 17 makes it possible to spray water through the nozzle 15 onto the blades of the fan 13. The water is thus sprayed during the rotation of the fan 13 onto the resistors 10 and is transformed into steam, thereby making it possible to increase the degree of humidity in the interior space 3.

The temperature variations inside the oven 1 may cause condensation phenomena, for example during the progressive cooling down of the oven starting from a state close to steam saturation. Condensates then form on the walls of the oven and flow towards the bottom through a conduit 18 on which is mounted the sensor 7 for measuring the temperature of the condensates.

The oven 1 furthermore comprises a discharge duct 19 mounted in an upper part of the enclosure 2 and equipped with a flap 20 moveable under the action of an actuator 21, for example an electric motor, linked to the central unit 8. The flap 20 can be closed, thereby preventing the circulation of air between the interior space 3 and the ambient atmosphere, or open. The oven 1 comprises a fan 22, for example of centrifugal type, driven by an electric motor, not represented, and whose outlet opens into the interior space 3 and may be shut off by a valve 23 controlled by an actuator 24, for example an electric motor, by way of a rod 25. The actuator 24 is linked to the central unit 8.

The resistors 10 make it possible to raise the temperature of the interior space 3. The heating power can be adjusted to ⅓ of the maximum power by energizing just one of the resistors 10 by way of the interface 11, to ⅔ of the maximum power by way of the interface 12, and to the maximum power by way of the two interfaces 11 and 12. The fan 13 allows air circulation in the interior space 3 and distribution of the heat produced by the resistors 10. The fan 13 also makes it possible, in association with the water spraying means, to raise the degree of humidity in the interior space 3 by distributing the water onto the resistors 10, thereby causing the immediate evaporation of the water. The conduit 18 allows the discharging of the condensates. The cold air feed means formed by the fan 22 and the associated elements and the hot air discharge means formed by the valve 20 and the associated elements, allow fast cooling of the interior space 3 by feeding of a large volume of cold air and discharging of a corresponding quantity of hot air, for example at a flow rate of the order of several tens of $m^3/h$. Furthermore, when the interior of the oven is at an elevated temperature, for example greater than 100°, the spraying of water by the nozzle 15 allows very fast cooling of the resistors 10, which will have been deenergized, and also allows cooling of the inside walls of the enclosure 2 which may be at very elevated temperatures. In this case, some of the water sprayed by the nozzle 15 will be vapourized and will escape through the conduit 19 and the valve 20, whereas some of it will condense and will be discharged through the discharge conduit 18.

Of course, the oven 1 is described merely by way of example. The invention applies to numerous types of ovens, simpler or more sophisticated than this one.

Figure 2:
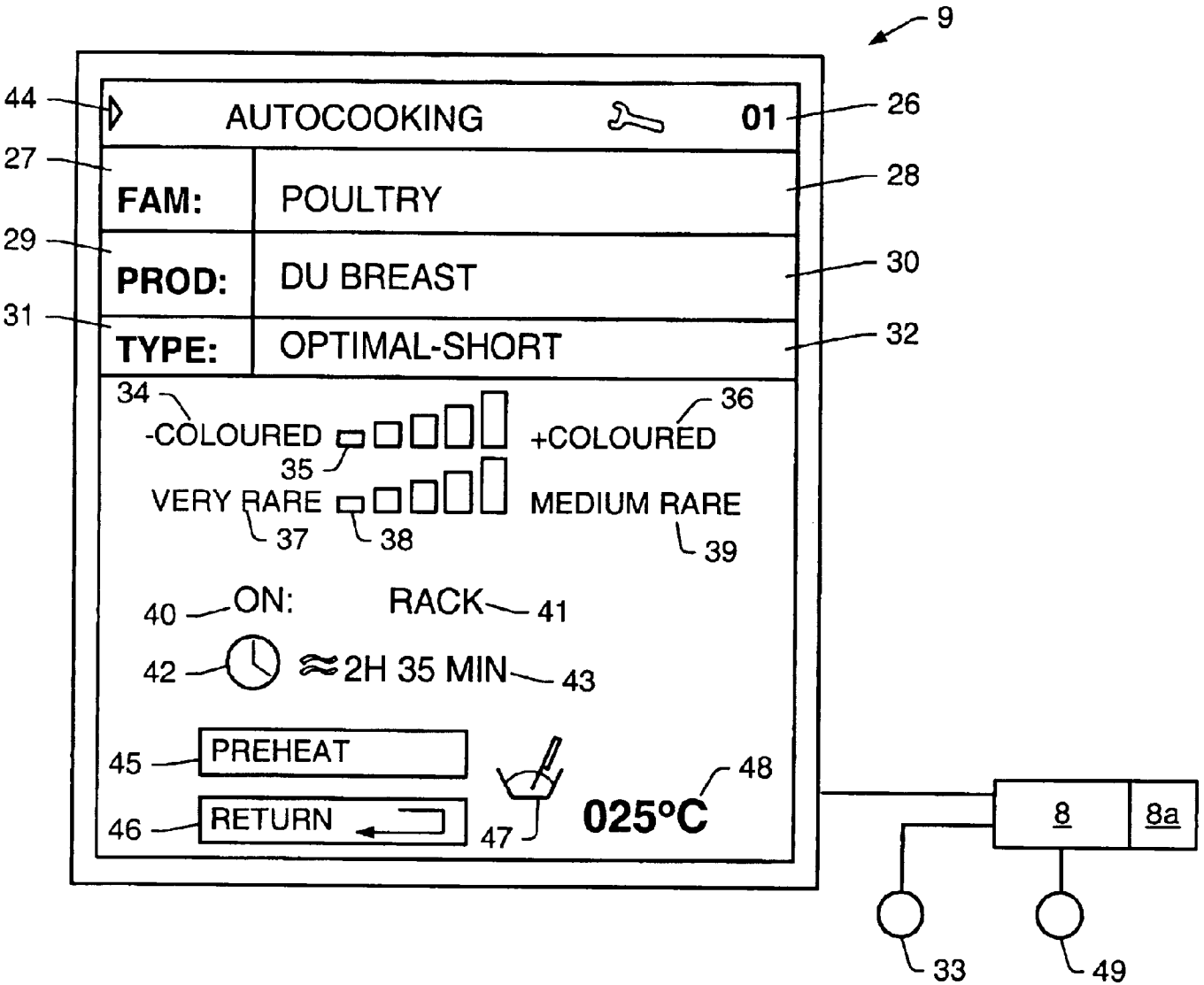
FIG. 2 is a diagrammatic view of a first window of the display screen and of the control system according to one aspect of the invention

As may be seen in FIG. 2, the control panel 9 is linked to the calculation unit 8. The display screen 9 comprises an upper zone 20 for displaying the cooking programme. Here, the display zone 26 indicates the "auto cooking" mode which signifies that an automatic cooking programme is selected and displays in the right part the number of the window displayed by the screen, here "01". Under the display zone 26 are juxtaposed display zones 27 and 28. The display zone 27 is dedicated to the display of the designation or of the name of a first grading criterion, here "FAM" for the family of products. The display zone 27 may be permanent. The display zone 28 is dedicated to the display of the selected value of the first criterion, hence of the family of products. Here the "poultry", product family is selected.

Under the display zones 27 and 28 are arranged juxtaposed display zones 29 and 30. The display zone 30, which may be permanent, is dedicated to the designation of the product which may be chosen within the family selected at the display zones 28. The display zone 30 is dedicated to the display of the selected product, here "DU breast", standing for breast of duck. Under the display zones 29 and 30 are provided juxtaposed display zones 31 and 32. The display zone 31 is dedicated to the display of the designation of the recipe or of the method of cooking generally referred to as "type of cooking". The display zone 32 is dedicated to the display of the selected value of the type of cooking, here "optimal short", signifying cooking of low duration ensuring a quality result.

Thus, the user firstly chooses the family of products, then chooses the product within the family of selected products, then chooses the type of cooking, that is to say the cooking recipe or a method of cooking proposed in respect of the selected product to be cooked.

In one embodiment of the invention, the display zones 26, 28, 30 and 32 are of the touch type, thereby allowing the user to scroll the choices on offer by touching the corresponding display zone.

In another embodiment of the invention, the selection is made by means of a separate button of the display screen 9, for example the button 33 linked to the calculation unit 8 and making it possible through a rightward rotation of the said button 33 to scroll the possible choices in one direction, through a leftward rotation to scroll them in the opposite direction and through a translational push, to confirm the value displayed in the display zone in the course of selection and which is then displayed in a contrasting manner.

In a preferred embodiment of the invention, the selection is made by means of two buttons, for example the button 33 making it possible through a rightward rotation of the said button 33 to scroll the possible choices in one direction, through a leftward rotation to scroll them in the opposite direction and a button 49 linked to the calculation unit 8 and making it possible through a translational push to confirm the criterion of which a value must be selected and then the value of the said criterion, said value being displayed in the display zone in the course of selection and which once selected is then displayed in a contrasting manner.

Under the display zones 31 and 32 are arranged three juxtaposed display zones 34 to 36 which are dedicated to the display of an external final criterion of cooking, for example of colour, of crust, etc. In the example illustrated, the external final criterion is the colour. The display zones 34 and 36 surrounding the display zone 35 are dedicated to the display of the direction of adjustment, the display zone 34 displaying the label "−coloured" and the display zone 36 displaying the label "+coloured". The display zone 35 displays a bar graph, that is to say a series of rectangles of constant width whose height progressively increases from left to right. The nonselected rectangles are displayed in outline and the selected rectangle, here the central rectangle, is displayed solid. The external final criterion of cooking, as displayed in zones 35 and 36, depends on the previous choices displayed in the zones 26, 28, 30 and 32. The label displayed by the display zones 34 and 36 depends on the prior choice of recipe.

The user moving the selection towards the left, chooses a less coloured final state of the product and conversely by moving it towards the right, chooses a more coloured final state of the product.

An inexperienced user is able to make an appropriate selection extremely quickly.

Under the display zones 34 to 36 are provided three display zones 37 to 39 that are similar to the previous ones and dedicated to an internal final criterion related to the product selected. The display zones 37 and 39 respectively display "very rare" and "medium rare", thereby allowing the user to select the final result and not a means whereby the desired final result may be arrived at in a more or less chance or hypothetical manner.

The zone 38 takes the form of a bar graph with five rectangles like the display zone 35, and makes it possible to select the value of the internal final criterion. The internal final criterion is defined as a function of the product, that is to say the label displayed by the display zones 37 and 39 depends on the prior choice of the family of products, of the product and possibly of the type of cooking. The internal final criterion may be a choice between very rare/medium rare cooking for red meats, pinkish/white for white meats, firm/tender, dry/moist for patisseries, half-cooked/cooked for foie gras, crisp/well done for vegetables, etc.

The display zones 35 and 38 can permanently display the five rectangles and temporarily display the selected rectangle displayed solid. Of course, this graphical display can take other shapes, for example a right-angled triangle in outline with a part displayed solid symbolizing the value chosen, or else a horizontally elongated rectangle represented in outline with a part displayed solid symbolizing the value chosen, etc. By default, a mid value of the internal criterion and of the external criterion is selected.

Under the display zones 37 to 39 are provided two display zones 40 to 41 intended for guiding the user with regard to the choice of cooking facility to be used. The display zone 40 may be permanent and indicate the term "on" to show the user that the adjacent zone 41 will indicate the utensil on which the product should be placed in the oven. The display zone 41 here displays the term "rack" and may display a term designating a utensil suitable for the family of products, for the product and for the type of cooking selected beforehand. For example, cooking may take place on a baking tray, on a perforated tray, etc. The window displayed depends on the prior selections made.

Under the display zones 40 and 41, are provided display zones 42 to 44. The permanent display zone 42 shows a pictogram of a clock dial, thus signifying the duration of cooking. The display 43 displays the duration of cooking estimated, here 2 hours 35 minutes, according to the prior selections made. The estimate of duration may be recalculated as a function of the oven load which is manifested as a faster or slower rise in temperature measured by the sensors 5, 6 and 7.

An arrow 44 is present in the display zone 26 in the left part and indicates the criterion currently being selected. The arrow 44 can move and be positioned in the display zones 27, 29, 31, 34 and 37.

A button 45, arranged under the display zones 42 and 43, is dedicated to the selection of preheating which will naturally be tailored as a function of the family of products, of the products and of the type of cooking chosen beforehand. By depressing the button 45, the user sets off a preheating phase.

The button 46, arranged under the button 45, makes it possible to instruct a return making it possible to go back to a selection already made. The display zone 47, arranged under the display zones 43 and 44, serves to indicate whether a probe 6 that penetrates to the middle is or is not used. The display zone 48, arranged in the bottom right of the display screen 9, indicates the instantaneous temperature of measurement by the sensor 5. The interior of the oven is here at a temperature of 25° C.

The calculation unit 8, which controls the display screen 9, comprises a database 8*a*, associating the various values of the criteria to be selected by the user. With the value "auto cooking" displayed in the display zone 26, will be associated a list of families of products to be selected in the display zone 28. For example, the list may be as follows: poultry, red meat, white meat, fish, vegetables and patisserie.

With each family of products is associated a list of products to be selected in the display zone 30. In the case of the poultry family of products, the list of products may be: breast of duck, roast duck, escalope of turkey, turkey drumstick, roast turkey, guinea fowl, roast chicken, coq au vin. With each product is associated a list of types of cooking offered to the user for selection.

Likewise, for each product chosen, and possibly for each type of cooking, there is provided an internal final criterion to be selected by virtue of the display zones 34 to 36, and an external final criterion to be selected by virtue of the display zones 37 to 39. With each product and with each type of cooking is also associated the type of cooking facility to be used which will be displayed in the display zone 41, the duration which will be displayed in the display zone 43, the duration possibly being modified through the choice made with regard to the final criteria, internal and external, and the temperature which may also be modified.

Stated otherwise, the database 8*a* comprises, among other things, a cooking modes field corresponding to the display zone 26, a families of products field, a products field, a types of cooking field, an external final criterion field, an internal final criterion field, a cooking facility field, a duration of cooking field and a temperatures field.

The invention allows fast choice of the family of products, of the product of type of cooking, by virtue of a hierarchization between the family of products and the product, and of the link between the type of cooking and the product.

Figure 3:
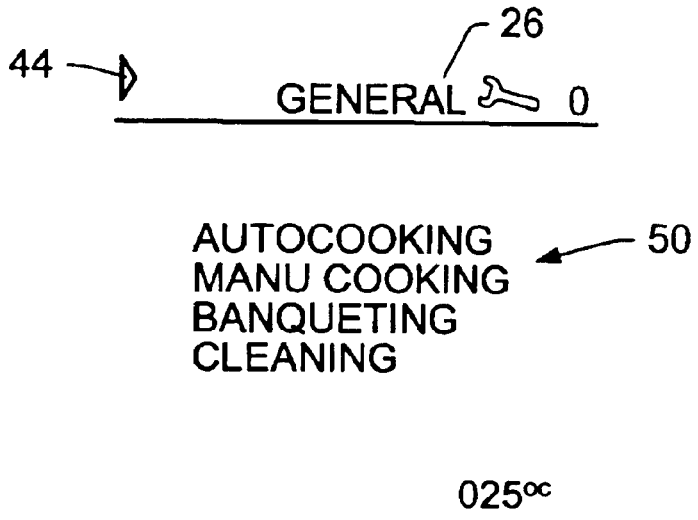
FIG. 3 is a diagrammatic view of a second window of the display screen.

Illustrated in FIG. 3 is another window displayed by the screen 9, for making a selection from the general menu. The arrow 44 is positioned in the display zone 26. The term "GENERAL" is displayed in the display zone 26. Under the display zone 26 is provided a display zone 50 offering four choices, of automatic cooking according to a programme selected by the user by means of the window illustrated in FIG. 2 with final criteria, of manual cooking where the user defines only the technical cooking parameters, in particular the temperature, the humidity the duration, etc., of communal catering, that is to say of heating through of ready-prepared meals or dishes. For communal catering, there is provided a plurality of automatic programmes following the principles described for cooking and cleaning offering a means of cleaning the oven in a simple manner. The user can move the arrow 44 downwards to position it opposite the choice that he wishes to select.

Figure 4:
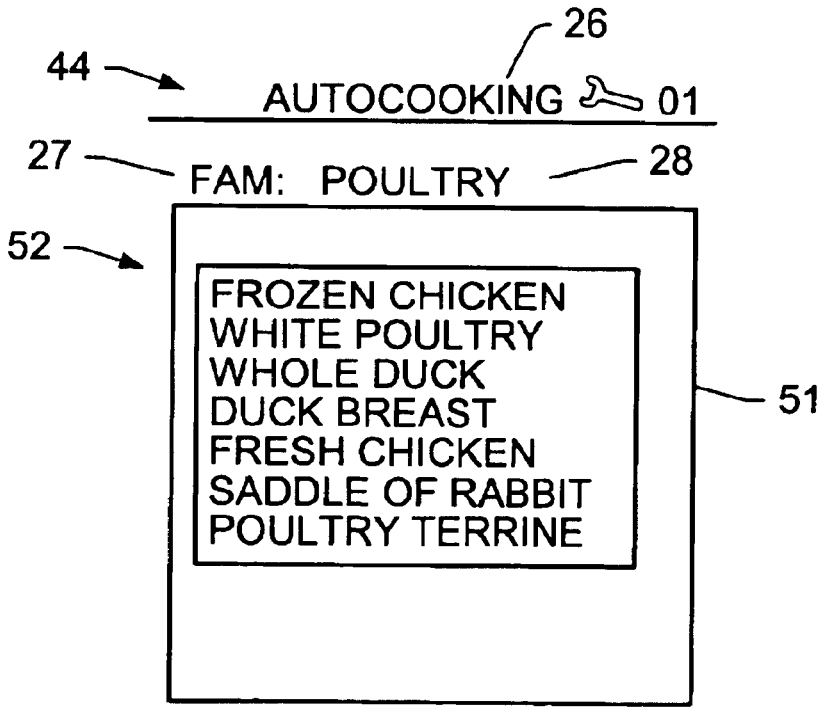
FIG. 4 is a diagrammatic view of a third window of the display screen.

Illustrated in FIG. 4 is another window displayed by the screen 9, for making a selection from a family of products, here poultry. The zones 26, 27 and 28 are similar to those illustrated in FIG. 2. Under the zones 27 and 28 is provided a zone 51 comprising several portions each offering a choice of type of poultry. The user can move an arrow 52 adjacent to the zone 51 to position it opposite the choice that he wishes to selected.

Figure 5:
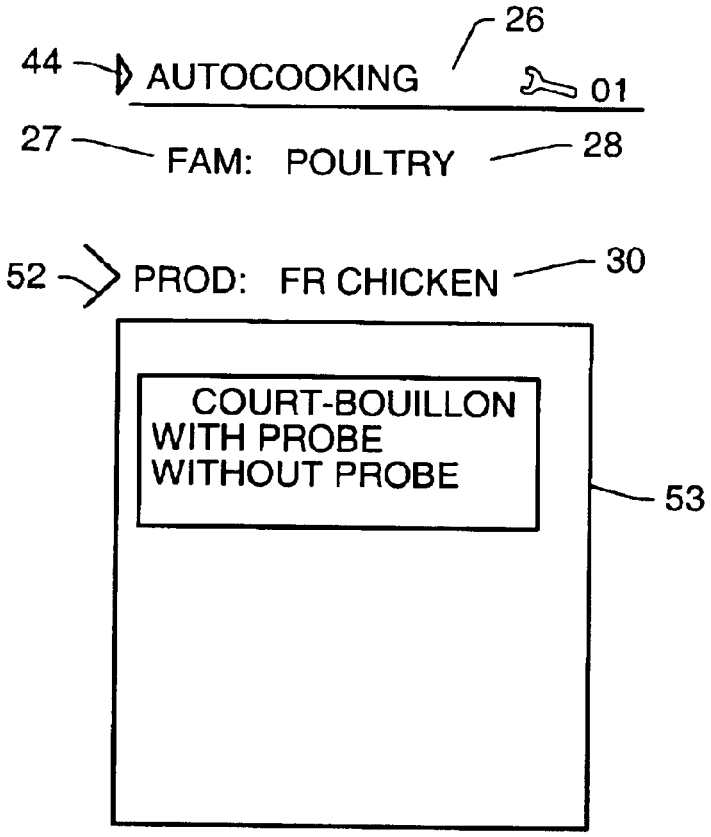
FIG. 5 is a diagrammatic view of a fourth window of the display screen.

Illustrated in FIG. 5 is another window displayed by the screen 9, for making a selection from a family of products, here poultry. The zones 26, 27, 28 and 30 are similar to those illustrated in FIG. 2. The zone 30 here displays "FR CHICKEN" which signifies frozen chicken. Under the zones 29 and 30 is provided a zone 53 comprising several portions each offering a choice of type of cooking. The user can move the arrow 52 so as to position it opposite the choice that he wishes to select.

Figure 6:
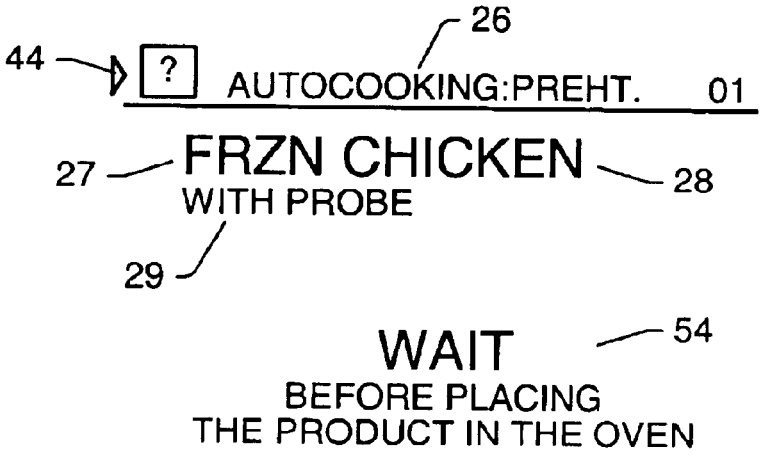
FIG. 6 is a diagrammatic view of a fifth window of the display screen.

Illustrated in FIG. 6 is another window displayed by the screen 9, subsequent to the selection of the with probe, choice made in FIG. 5. The zone 26 says "autocooking:preht", signifying that a preheating step is in progress. The zones 27 and 28 display "frzn chicken" standing for frozen chicken. The zone 29 displays "with probe" indicating that a temperature probe is used. The temperature probe is stuck into the item to be cooked, here chicken. A central zone 54 indicates that the user should wait before placing the product in the oven.

Figure 7:
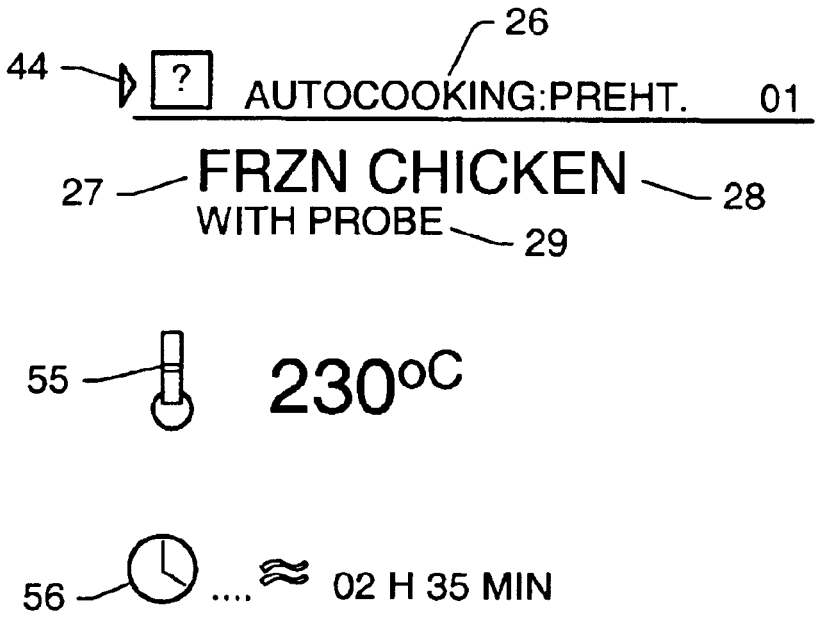
FIG. 7 is a diagrammatic view of a sixth window of the display screen.

Illustrated in FIG. 7 is a window displayed by the screen 9 after that of FIG. 6. FIG. 7 differs from FIG. 6 in that the central zone 54 is replaced with a zone 55 displaying a stylized thermometer and the temperature chosen, here 230° C., for cooking, and with a zone 55 displaying a stylized watch dial and the duration of cooking chosen, here 2h 35 min. Of course, the user can adjust these settings at will.

Figure 8:
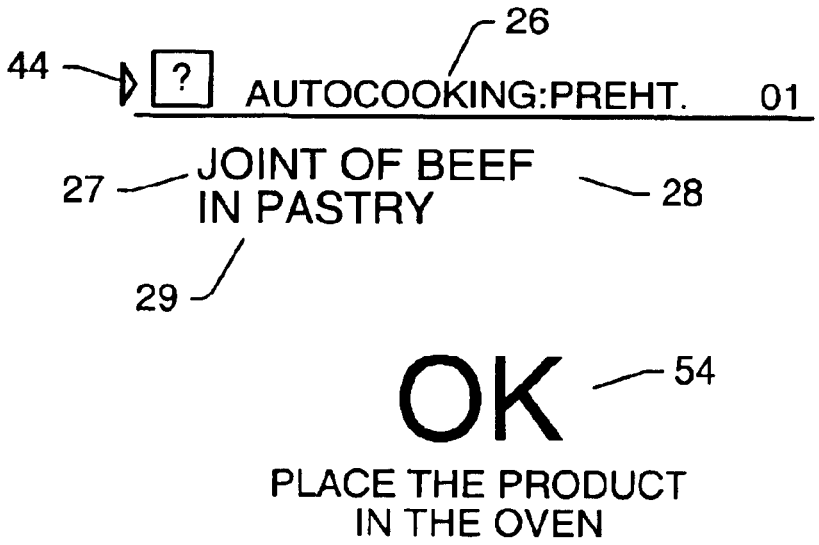
FIG. 8 is a diagrammatic view of a seventh window of the display screen.

Illustrated in FIG. 8 is another window displayed by the screen 9 at the end of preheating. The oven is now at the scheduled temperature to begin cooking. The zone 26 says "autocooking:preht" signifying that a preheating step is in progress. The zones 27 and 28 display "joint of beef". The zone 29 displays "in pastry" indicating the recipe and hence a particular mode of cooking. The central zone 54 indicates that the user can now place the product in the oven.

Figure 9:
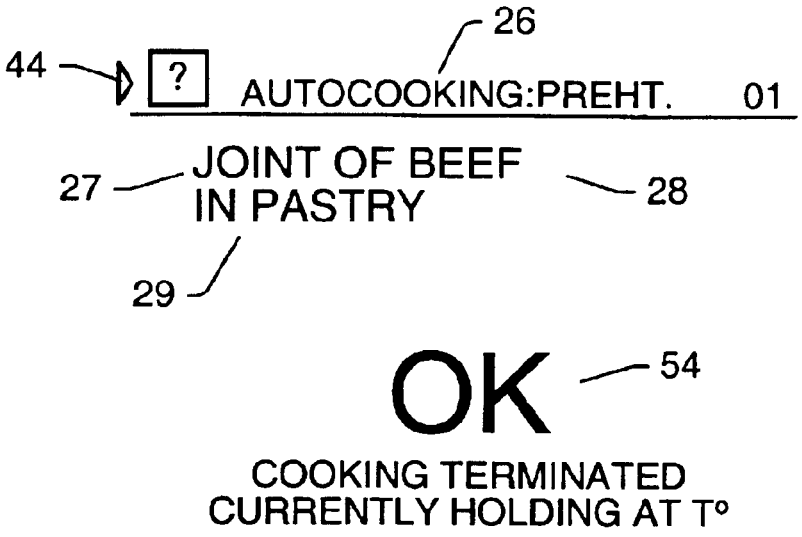
FIG. 9 is a diagrammatic view of an eighth window of the display screen.

Illustrated in FIG. 9 is another window displayed by the screen 9 at the end of cooking. The zone 26 says "auto-cooking". The zones 27, 28 and 29 are similar to those of FIG. 8. The zone 54 indicates the state of cooking terminated and the action in progress of maintaining temperature. A zone 48, see FIG. 2, can display the current temperature in the oven or the temperature measured by a probe in the product to be cooked.

Figure 10:
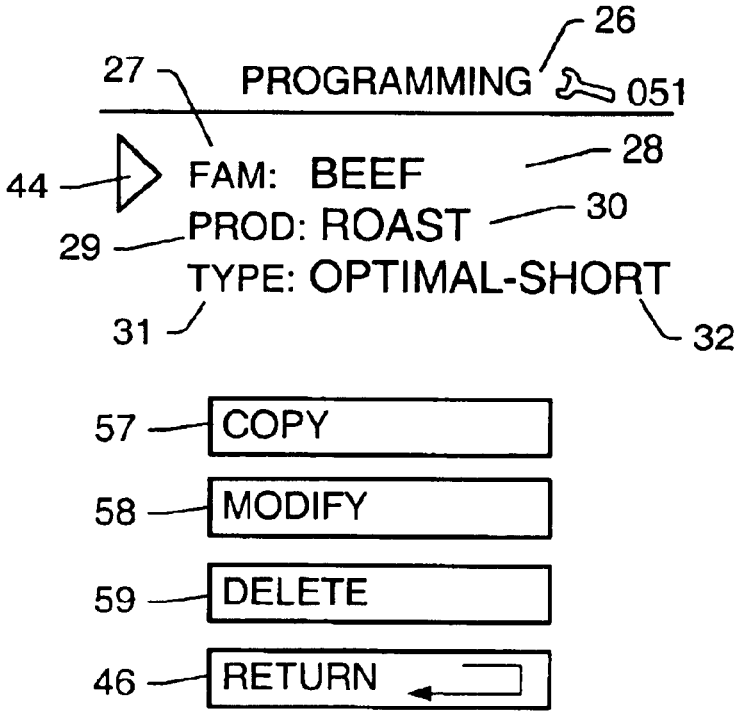
FIG. 10 is a diagrammatic view of a ninth window of the display screen.

Illustrated in FIG. 10 is a programming window displayed by the screen 9. The zone 26 displays "programming" and the programme number, here "051". The zones 27 to 32 are similar to those of FIG. 2. A lower zone 57 displaying "copy" offers the user the option to copy the programme for example onto a removable memory medium. A lower zone 58 displaying "modify" offers the user the option to modify the programme or a part of the programme. A lower zone 59 displaying "delete" offers the user the option to delete the programme.

Figure 11:
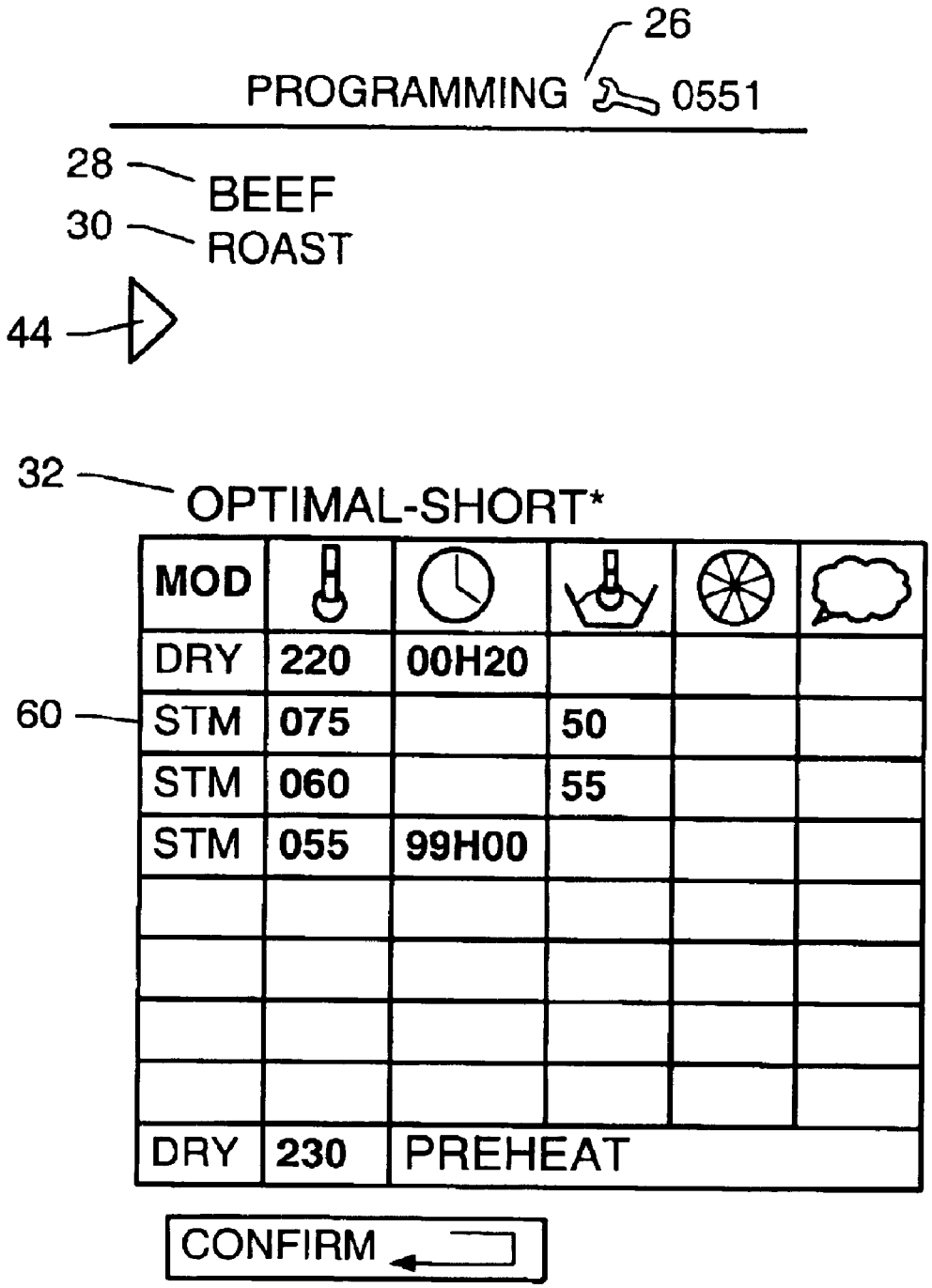
FIG. 11 is a diagrammatic view of a tenth window of the display screen.

Illustrated in FIG. 11 is a programming window displayed by the screen 9. The zones 28, 30 and 32 are similar to those of FIG. 10. A central zone of the screen 9 displays a panel 60 whose rows correspond to the steps of cooking and whose columns correspond to the presets during the steps. The first column defines the mode of cooking, for example dry or steam. The second column defines the preset for the oven temperature. The third column defines the duration of the step. The fourth column defines the temperature measured by the probe at which the step in progress is halted so as to go to the next step. The fifth column defines whether or not a fan function is implemented. The last row defines the preheating. The user can thus ascertain a clear overview of the technical criteria for cooking that he will have chosen via final criteria. The user can modify the technical criteria if he feels able to do so. The user may also use just the final criteria that are simpler to comprehend.

The invention affords the user, experienced or inexperienced, the ability to choose the final result of the cooking, such as it may be verified by observing the cooked product or by tasting, and not a technical cooking criterion which requires much more thorough knowledge and sometimes relatively lengthy trials.

What is claimed is:

1. An oven control system comprising, a display screen, a data input device and a calculation unit, wherein the calculation unit is configured to send instructions to the display screen and to receive instructions from the data input device, wherein the calculation unit is further configured to select cooking programs at least as a function of a first criterion of a family of products to be cooked, of a product to be cooked within a family, or of a recipe or of a method of cooking and to adjust the cooking program according to at least one second internal final criterion and one third external final criterion, wherein the display screen is configured to display the selected values of the criteria simultaneously or the values of the criteria currently being selected by a user simultaneously, wherein the display screen is configured to display unselected values of the criteria in such a way that the selected values can be read graphically, wherein the display screen comprises a display zone for displaying the values of the second and the third criteria, and wherein the display zone is configured to display a window adapted to each type of product.

2. The system of claim 1, wherein the display screen comprises a first display zone for names of the first criterion and a second display zone for the selected value of the first criterion or of the values currently being selected.

3. The system of claim 2, wherein the first display zone for the name of the first criterion is permanent.

4. The system of claim 1, wherein the display zone for the values of the second and the third criteria comprises at least one criterion-based bar graph.

5. The system of claim 1, wherein the display screen comprises a display zone for names of the second and the third criteria.

6. The system of claim 5, wherein the display zone for the names of the second and the third criteria is arranged on both sides of the display zone for the values of the second and the third criteria.

7. The system of claim 1, wherein the second and the third criteria are selected from a list of criteria.

8. The system of claim 1, wherein the calculation unit comprises a storage table associating an instruction for displaying the adapted window with each type of product.

9. The system of claim 1, wherein the calculation unit is configured to select cooking programs at least as a function of a fourth criterion and of a fifth criterion.

10. An oven comprising a frame, a door, a heating device, and a control system, wherein the control system comprises a display screen, a data input device and a calculation unit, wherein the calculation unit is configured to send instructions to the display screen and to receive instructions from the data input device, wherein the calculation unit is further configured to select cooking programs at least as a function of a first criterion of a family of products to be cooked, of a product to be cooked within a family, or of a recipe or of a method of cooking and to adjust the cooking program according to at least one second internal final criterion and one third external final criterion, wherein the display screen is configured to display the selected values of the criteria simultaneously or the values of the criteria currently being selected by a user simultaneously, wherein the display screen is configured to display unselected values of the criteria in such a way that the selected values can be read graphically, wherein the display screen comprises a display zone for displaying the values of the second and the third criteria, and wherein the display zone is configured to display a window adapted to each type of product.

11. The oven of claim 10, wherein the display screen comprises a first display zone for names of the first criterion and a second display zone for the selected value of the first criterion or of the values currently being selected.

12. The oven of claim 11, wherein the first display zone for the name of the first criterion is permanent.

13. The oven of claim 10, wherein the display zone for the values of the second and the third criteria comprises at least one criterion-based bar graph.

14. The oven of claim 10, wherein the display screen comprises a display zone for names of the second and the third criteria.

15. The oven of claim 14, wherein the display zone for the names of the second and the third criteria is arranged on both sides of the display zone for the values of the second and the third criteria.

16. The oven of claim 10, wherein the second and the third criteria are selected from a list of criteria.

17. The oven of claim 10, wherein the calculation unit comprises a storage table associating an instruction for displaying the adapted window with each type of product.

18. The oven of claim 10, wherein the calculation unit is configured to select cooking programs at least as a function of a fourth criterion and of a fifth criterion.

* * * * *